US005260509A

United States Patent [19]

Shimada et al.

[11] Patent Number: 5,260,509

[45] Date of Patent: Nov. 9, 1993

[54] AUTO-ACCOMPANIMENT INSTRUMENT WITH SWITCHED GENERATION OF VARIOUS PHRASE TONES

[75] Inventors: Yoshihisa Shimada; Shinya Konishi, both of Hamamatsu, Japan

[73] Assignee: Kabushiki Kaisha Kawai Gakki Seisakusho, Shizuoka, Japan

[21] Appl. No.: 920,824

[22] Filed: Jul. 28, 1992

[30] Foreign Application Priority Data

Aug. 1, 1991 [JP] Japan ..... 3-215799

[51] Int. Cl.[5] ..... G10H 1/06; G10H 1/38; G10H 1/42

[52] U.S. Cl. ..... 84/622; 84/635; 84/637; 84/DIG. 12; 84/DIG. 22

[58] Field of Search ..... 84/609-614, 84/634-638, DIG. 12, DIG. 22, 622-625

[56] References Cited

U.S. PATENT DOCUMENTS 4,981,066 1/1991 Kakizaki ..... 84/613

*Primary Examiner*—Stanley J. Witkowski

[57] ABSTRACT

An auto-play electronic musical instrument stores note data of phrase tones for one bar corresponding to each of a plurality of keys of two octaves together with auto-accompaniment pattern data. Every time a key is operated, an adlib play is made by playing back corresponding phrase tones. When a key operation is interrupted during the adlib play, specific phrase tone are repetitively and automatically played back, thereby preventing a play from being interrupted halfway. The electronic musical instrument also stores fixed phrases such as introduction, fill-in, ending phrases, and the like, which are required according to the flow of a play. When one of the fixed phrases is played back by a selection button while the specific phrase is repetitively played back, the repetitive playback operation of the specific phrase is restarted when the playback operation of the fixed phrase ends. As a result, a user can play similar to a professional artist even with one finger in this key-on phrase play mode.

9 Claims, 19 Drawing Sheets

FIG. 5

42a

| | INTONATION 1 | | | | | | | | | |
|---|---|---|---|---|---|---|---|---|---|---|
| | VELO | COLOR/ INST. | PATTERN | | | | | | | |
| | | | 1.0 | 1.2 | 2.0 | 2.2 | 3.0 | 3.2 | 4.0 | 4.2 |
| CHORD | 00H | 01H,NC | 0000H | | 0001H | | 0002H | | 0003H | |
| BASS | 00H | 40H,NC | 0100H | | | | 101H | | | |
| DRUM1 | 00H | 00H,00H | 1000H | REP | | | | | | |
| DRUM2 | 00H | 00H,00H | 1100H | | 1101H | | 1102H | | 1103H | |
| DRUM3 | 00H | 00H,00H | 1200H | | 1201H | | 1202H | | 1203H | |

| | INTONATION 2 | | | | | | | | | |
|---|---|---|---|---|---|---|---|---|---|---|
| | VELO | COLOR/ INST. | PATTERN | | | | | | | |
| | | | 1.0 | 1.2 | 2.0 | 2.2 | 3.0 | 3.2 | 4.0 | 4.2 |
| CHORD | 00H | 01H,NC | 0000H | | 0001H | | 0002H | | 0003H | |
| BASS | 00H | 40H,NC | 0102H | | | | 103H | | | |
| DRUM1 | 00H | 26H,28H | 1000H | REP | | | | | | |
| DRUM2 | 00H | 00H,00H | 1100H | | 1101H | | 1102H | | 1103H | |
| DRUM3 | 00H | 00H,00H | 1200H | | 1201H | | 1202H | | 1203H | |

42b

AUTO-ACCOMPANIMENT INSTRUMENT WITH SWITCHED GENERATION OF VARIOUS PHRASE TONES

BACKGROUND OF THE INVENTION

1. Field of the Invention

The present invention relates to an auto-play apparatus for an electronic musical instrument, which plays a phrase for one bar including a plurality of corresponding tones every time a key operation is performed.

2. Description of the Related Art

In general, an electronic keyboard (e.g., an electronic piano) comprises an auto-accompaniment function including a rhythm auto-accompaniment mode, a chord-/bass auto-accompaniment mode, and the like. In some electronic musical instruments, different phrases each for about one bar are assigned to a plurality of keys, and these phrases are selectively read out by one-finger key operations, thereby obtaining an adlib-like play effect upon coupling of a series of phrases (so-called a one-finger adlib play function).

An electronic musical instrument having all the above-mentioned functions, i.e., the rhythm accompaniment function, the chord accompaniment function, and the adlib phrase play function, comprises a minimum required number of tracks (tone generation channels) so as not to cause omission of tones even when all the functions operate. However, all the tracks are not always utilized.

SUMMARY OF THE INVENTION

The present invention has been made in consideration of the above situation, and has as its object to provide an auto-play apparatus for an electronic musical instrument, which performs an auto-play operation by effectively utilizing unused tracks, thereby generating a colorful tone-up state of play.

It is another object of the present invention to provide an auto-play apparatus for an electronic musical instrument, which can insert special phrases such as an introduction phrase, a fill-in phrase, an ending phrase, and the like when an auto-play operation is performed using unused tracks, thereby generating a further colorful tone-up state.

An auto-play apparatus according to the present invention comprises note data storage means for storing note data strings of auto-play tones containing accompaniment tones and melodious phrases, tone generation means for generating tones on the basis of the note data string read out from the note data storage means, means for selecting the note data string corresponding to one of different phrases assigned to a plurality of keys according to a key operation, and supplying the selected note data string to the tone generation means, means for selecting the note data string corresponding to a phrase assigned to at least one selection button, and supplying the selected note data string to the tone generation means, means for, when the key operation is interrupted while a phrase play for generating phrase tones in response to key operations is being performed, repetitively selecting the note data string corresponding to one specific phrase, and supplying the selected note data string to the tone generation means, and interrupt means for, when the selection button is operated while the specific phrase is being played, playing one phrase corresponding to the selection button in place of a play operation of the specific phrase, and restarting the repetitive play operation of the specific phrase upon completion of the play operation of one phrase corresponding to the selection button.

When an adlib play of phrases is performed in correspondence with key operations, since the intervals between adjacent key operations can be filled with an auto-play operation of a predetermined phrase, the tone-up state of a play can be maintained. No special tracks for this auto-play operation are required. When an auto-play operation of a predetermined phrase is performed, since a phrase assigned to a selection operation member can be desirably inserted, a play with an accent can be performed even when all tracks are busy.

BRIEF DESCRIPTION OF THE DRAWINGS

FIG. 5 shows the formats of intonation pattern data;

DETAILED DESCRIPTION OF THE PREFERRED EMBODIMENT

Figure 1:
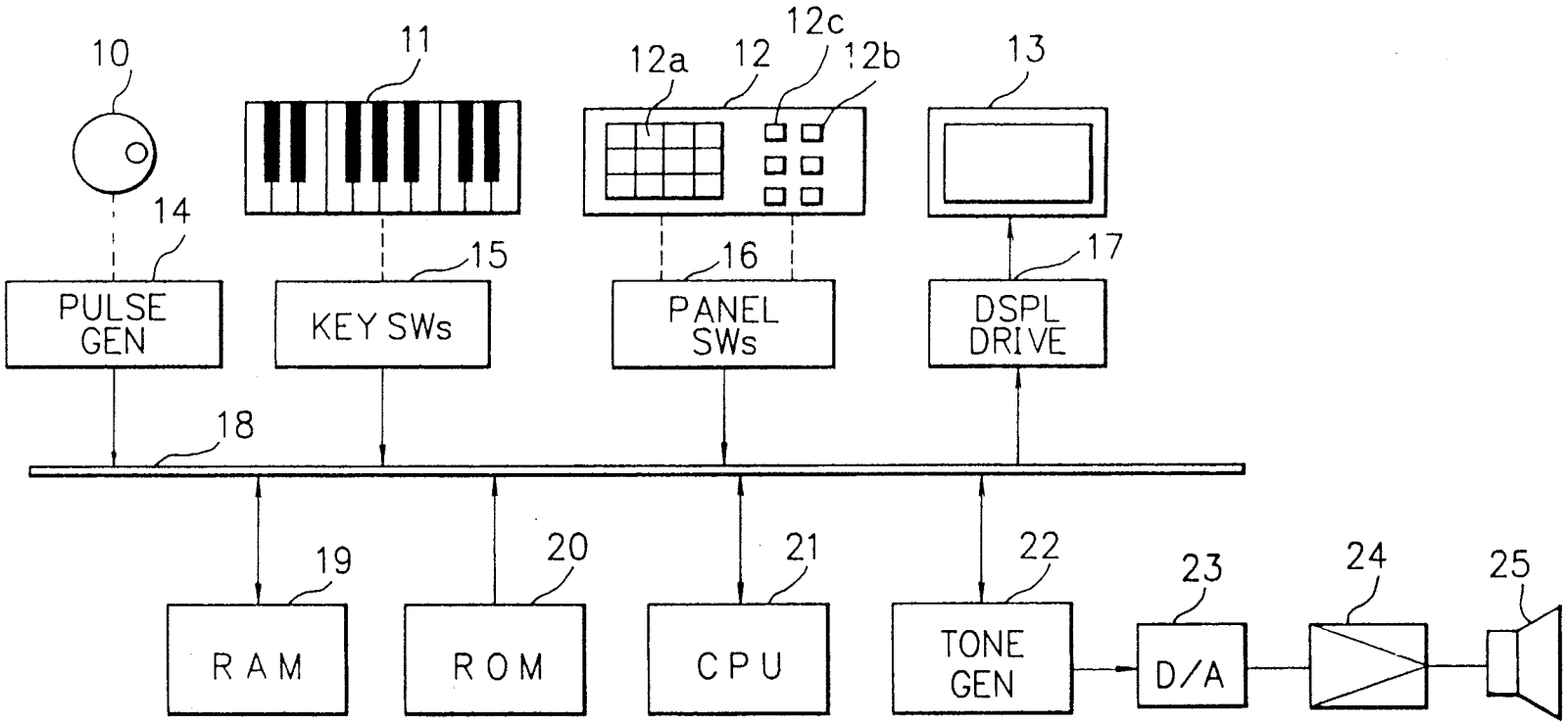
FIG. 1 is a block diagram of an electronic musical instrument according to an embodiment of an auto-play apparatus of the present invention.

FIG. 1 is a block diagram showing principal part of an electronic musical instrument according to an embodiment of the present invention. This electronic musical instrument comprises a keyboard 11, an operation panel 12, and a display 13. A dial 10 for indicating the tone-up level of a play is arranged aside the keyboard 11.

The circuit portion of the electronic musical instrument comprises a microcomputer including a CPU 21, a ROM 20, and a RAM 19, which are connected through a bus 18. The CPU 21 detects operation information of the keyboard 11 from a key switch circuit 15 connected to the keyboard 11, and detects operation information of panel switches from a panel switch circuit 16 connected to the operation panel 12. The dial 10 is connected to a pulse generator 14. The CPU 21 counts pulses generated by the pulse generator 14 according to a dial operation, thereby obtaining tone-up level information (intonation value).

A rhythm and a type of instrument selected by the operation panel 12, an intonation value corresponding to the dial operation, and the like are displayed on the basis of display data supplied from the CPU 21 to the display 13 through a display drive circuit 17.

The CPU 21 supplies note information corresponding to keyboard operations, and parameter information such as a rhythm, a tone color, and the like corresponding to panel switch operations to a tone generator 22. The tone generator 22 reads out PCM tone source data from the ROM 20 on the basis of the input information, processes the amplitude and envelope of the readout data, and outputs the processed data to a D/A converter 23. A tone signal obtained from the D/A converter 23 is supplied to a loudspeaker 25 through an amplifier 24.

The ROM 20 stores auto-accompaniment data. The CPU 21 reads out auto-accompaniment data corresponding to an operation of an auto-accompaniment selection button on the operation panel 12 from the ROM 20, and supplies the readout data to the tone generator 22. The tone generator 22 reads out waveform data such as chord, bass, drum tones, and the like from the ROM 20, and supplies the readout data to the D/A converter 23. Therefore, auto-accompaniment chord, bass, and drum tones are obtained from the loudspeaker 25 together with tones corresponding to key operations.

Figure 2:
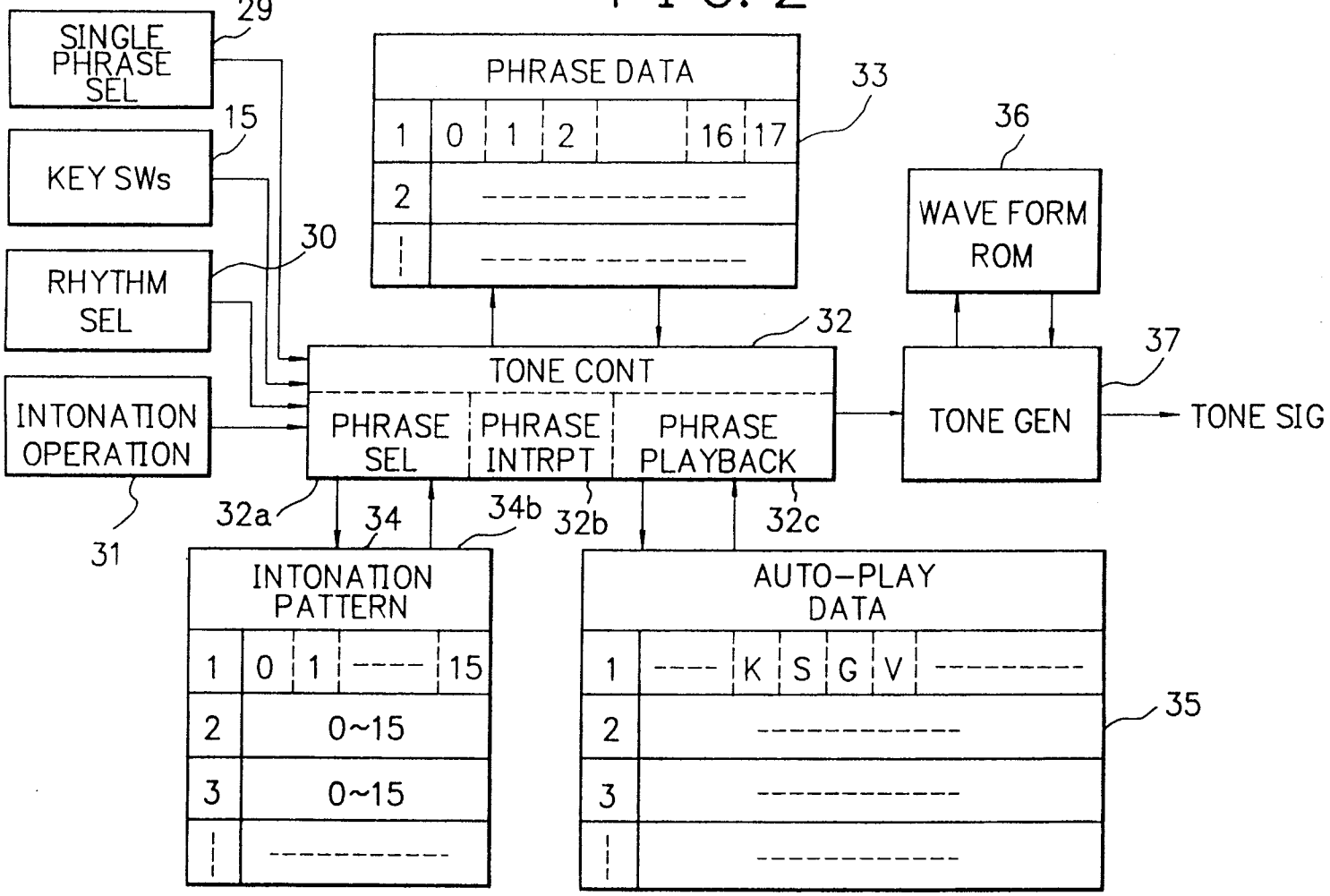
FIG. 2 is a block diagram showing elemental features of the auto-play apparatus of the present invention.

FIG. 2 is a block diagram showing the arrangement of principal parts of the electronic musical instrument. An intonation operation unit 31 corresponds to the dial 10 and the pulse generator 14 shown in FIG. 1. A rhythm selection unit 30 comprises ten-key switches 12*a* provided to the operation panel 12. The operation panel 12 is also provided with selection buttons 12*b* for selecting various modes such as a rhythm accompaniment mode, an auto chord accompaniment mode, an adlib phrase play mode, and the like. Furthermore, the operation panel 12 is provided with selection buttons 12*c* for selecting special single phrases such as an introduction phrase, a fill-in phrase, an ending phrase, and the like to automatically play the selected phrase. These selection buttons 12*c* constitute a single phrase selection unit 29.

When the dial 10 is operated according to the tone-up state of a play, output pulses from the pulse generator 14 are supplied to a tone controller 32. A rhythm number and a phrase number selected by the rhythm selection unit 30 and the single phrase selection unit 29 are supplied to the tone controller 32. Operation information of the keyboard 11 is supplied to the tone controller 32 through the key switch circuit 15.

The tone controller 32 comprises a selection means 32*a* for selecting a phrase corresponding to a key, an interrupt means 32*b* for inserting a playback operation of a single phrase such as a fill-in phrase in an auto-play operation, and a phrase playback means 32*c* for repetitively playing back a specific phrase when no key event is detected.

Figure 3:
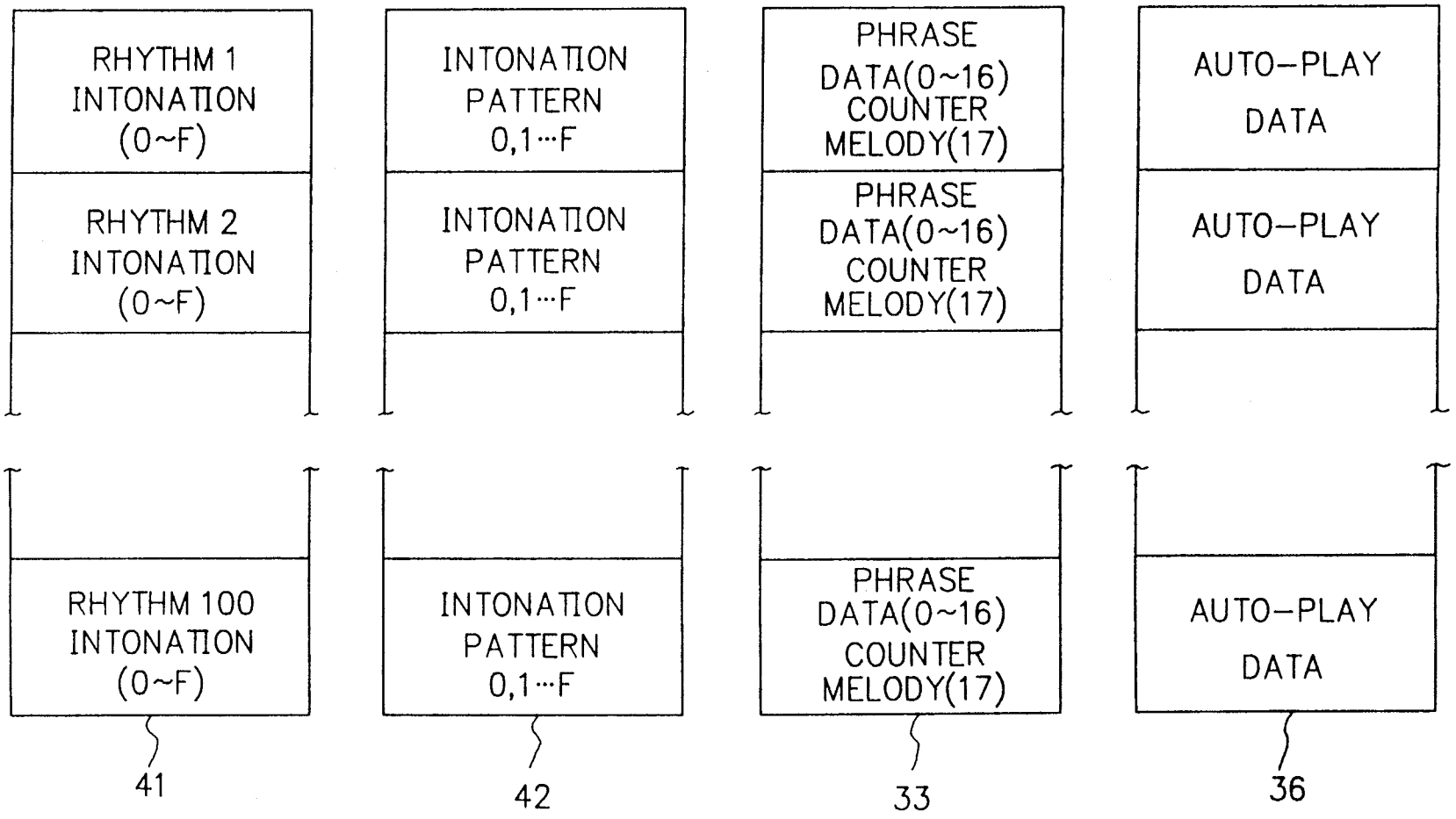
FIG. 3 shows the formats of auto-play data.

An intonation pattern memory 34 connected to the tone controller 32 is allocated in ROM 20, and has intonation pattern tables 42 of a plurality of levels (e.g., 16 (0 to 15)) corresponding to intonation values in units of rhythms, as shown in FIG. 3. Therefore, intonation pattern data 34*a* of a predetermined level corresponding to the selected rhythm and the input intonation value is read out from the memory 34, and is supplied, as an auto-accompaniment pattern, to the tone controller 32. For example, when the selection rhythm number is "1", and the intonation value is "2", the intonation pattern data 34*a* of the corresponding level "2" is read out.

The intonation pattern data is partially used as a subphrase pattern 34*b*. The subphrase pattern is read out so as to select and play back a subphrase (single phrase) such as an introduction phrase, an ending phrase, a fill-in phrase, or the like by the corresponding selection button 12*c*.

Figure 4:
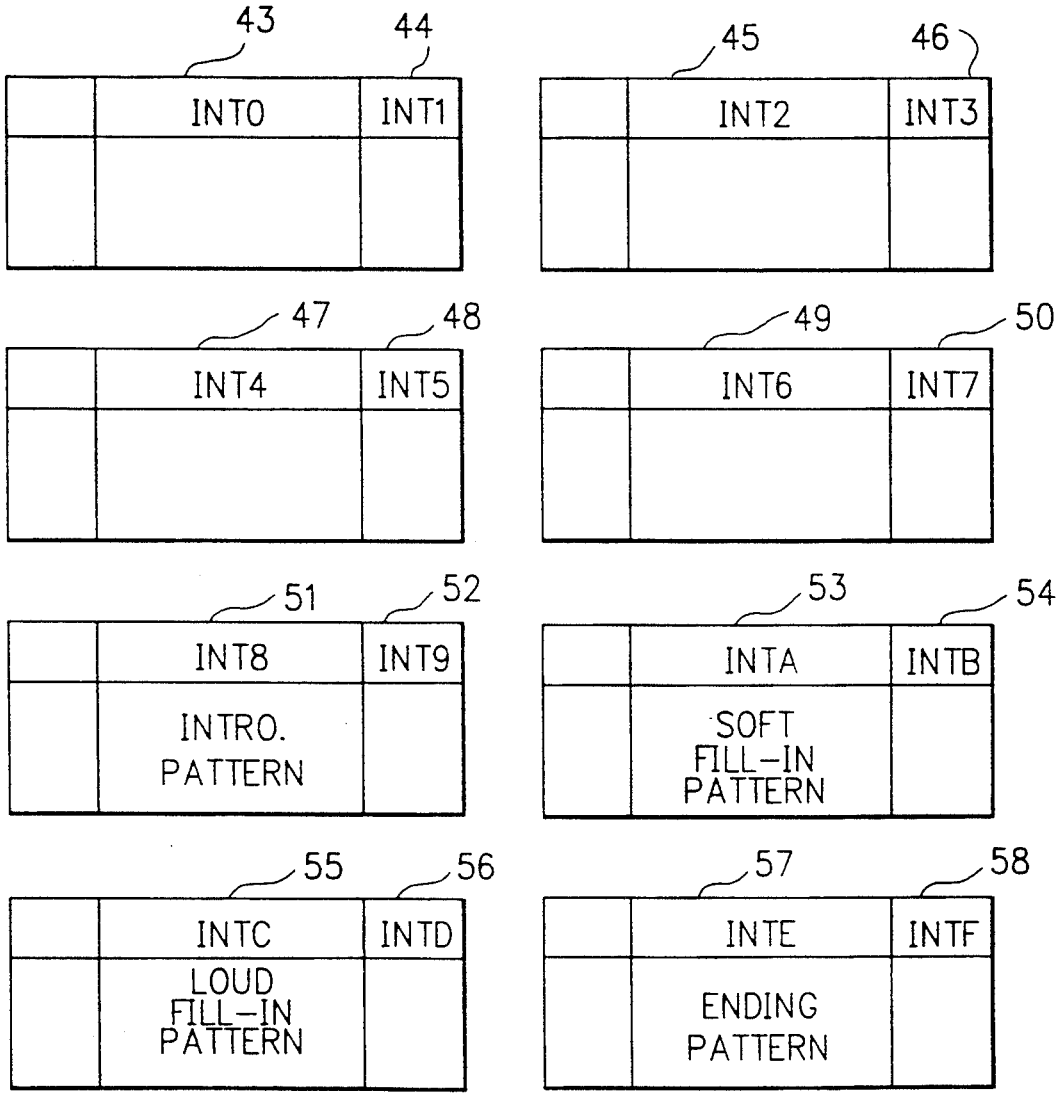
FIG. 4 shows the formats of auto-play data corresponding to intonation values.

FIG. 4 shows the arrangement of intonation pattern data corresponding to one rhythm. Sixteen intonation pattern data 43 to 58 are arranged in the order of intonation values INT0 to INTF (F=15). The intonation pattern data 43 to 50 corresponding to the intonation values INT0 to INT7 are used for controlling the intonation values. The intonation pattern data 51 to 58 corresponding to the intonation values INT8 to INTF are used as subphrase patterns including patterns (51 and 52), soft fill-in patterns (53 and 54), loud fill-in patterns (55 and 56), and ending patterns (57 and 58).

A phrase data memory 33 connected to the tone controller 32 is allocated on the ROM 20, and has phrase data tables 43 each consisting of 17 different key phrase data assigned to 17 keys (0 to 16) in units of rhythms, as shown in FIG. 3. Each key phrase data includes play pattern data for reading out note data for about one bar from a play data memory. In the adlib phrase play mode, phrases are assigned to specific 17 keys in correspondence with the selected rhythm. When one key is depressed, corresponding phrase data is read out from the phrase data memory 33. Based on the readout data, note data constituting a 4-beat phrase are read out from an auto-play data memory 35, and are played back. Since all the phrases corresponding to the 17 keys are different from each other, an adlib play can be easily performed by operating keys at every 4-beat timing.

Counter-melody data is stored as 17th data of each rhythm in the phrase data memory 33. The counter-melody data is automatically played back as a substitution of an adlib phrase play through a phrase playback track (channel) as a counter track for a melody line when a predetermined condition is satisfied. Thus, the tone-up state of a play is maintained when key operations are interrupted.

The tone controller 32 reads out auto-play data from the auto-play data memory 35 on the basis of play pattern data in intonation pattern data, or phrase data, and modifies the readout auto-play data with data for designating a tone volume, a tone color, an instrument, and the like, and supplies the modified data to a tone generator 37. The auto-play data memory 35 is allocated on the ROM 20, and comprises tables storing note data strings for auto-accompaniment tones such as chord, bass, drum tones, and the like in units of rhythms, as shown in FIG. 3. Each note data includes key (interval) number data, tone generation timing data, tone duration data, tone volume data, and the like.

Note that the ROM 20 comprises tables 41 storing intonation preset values in units of rhythms, as shown in FIG. 3.

The tone generator 37 reads out a corresponding PCM tone source waveform from the waveform ROM 36 on the basis of note data from the tone controller 32, and forms tone signals. Thus, auto-accompaniment tones can be obtained. In addition, the intonation level of accompaniment tones can be desirably changed by a dial operation.

FIG. 5 shows details of the format of intonation pattern data. The intonation pattern data of one level includes five tracks (channels) of data including a chord track, a bass track, and drum 1 to drum 3 tracks. Each track includes a tone volume difference value VELO, tone color/instrument designation data, and play pattern data. Therefore, these data can be changed or designated in units of tracks.

A 1-byte tone volume difference value VELO is a value to be added to a tone volume value of each tone of auto-play data. This difference value can give an accent (tone volume level) in units of tones of each track. For example, the tone difference values in the tracks of intonation pattern data 42*a* and 42*b* of levels 1 and 2 in FIG. 5 are respectively "0".

2-byte tone color/instrument data is tone color/instrument change instruction information. A 1-byte tone color parameter is assigned to each of chord and bass tracks, and the remaining one byte is not used (NC). In FIG. 5, chord and bass tone color parameters in the intonation pattern data of levels 1 and 2 are respectively 01H and 40H.

2-byte instrument conversion information is assigned to each of drum 1 to drum 3 tracks. In note information of a drum track, scale data (key data) is normally assigned as instrument information. For example, "C" is assigned to a bass drum, "D" is assigned to a snare drum, and "E" is assigned to a hi-hat. In the intonation pattern data of level 2 in FIG. 5, the drum 1 track stores data "26H,28H". This data indicates that "26H" (closed hi-hat) in note data is converted into "28H" (open hi-hat). Therefore, even when the same note data are used, drum tones of different instruments can be generated according to the intonation level.

Different instruments can be assigned to three drum channels. Since the instruments can be changed in units of tracks, a change in intonation pattern according to the level can have a high degree of freedom. Since each drum track can also access common note data, the volume of note data can be prevented from being considerably increased even when the number of drum channels is increased.

A play pattern portion of intonation pattern data includes note designation information for four bars. This note designation information is address data indicating specific positions of note data in practice. One bar consists of four beats, and for example, 1.0 and 1.2 respectively indicate the first and third beats of one bar. For example, in the chord track of the intonation pattern data of level 1, a playback operation of notes for four beats of the first bar progresses from address 0000H of note data, and a playback operation of notes progresses from address 0001H in the second bar. A repeat mark REP is stored at the end of the fourth bar. When the playback operation progresses up to this mark, the control returns to the top address.

When the note designation information of the play pattern portion is changed, a play pattern can be easily changed. For example, in the intonation pattern data of level 1, 0100H and 0101H are assigned as designation information of the bass track. In the intonation pattern data of level 2, the above data are changed to 0102H and 0103H. Therefore, in the data of level 2, the instrument of the drum 1 track is changed, and the play pattern of a bass line is changed. In this manner, when the play pattern portion is partially changed, different intonation levels can be easily set, and an auto-play operation having a change corresponding to the tone-up state of a play can be performed.

Figure 6:
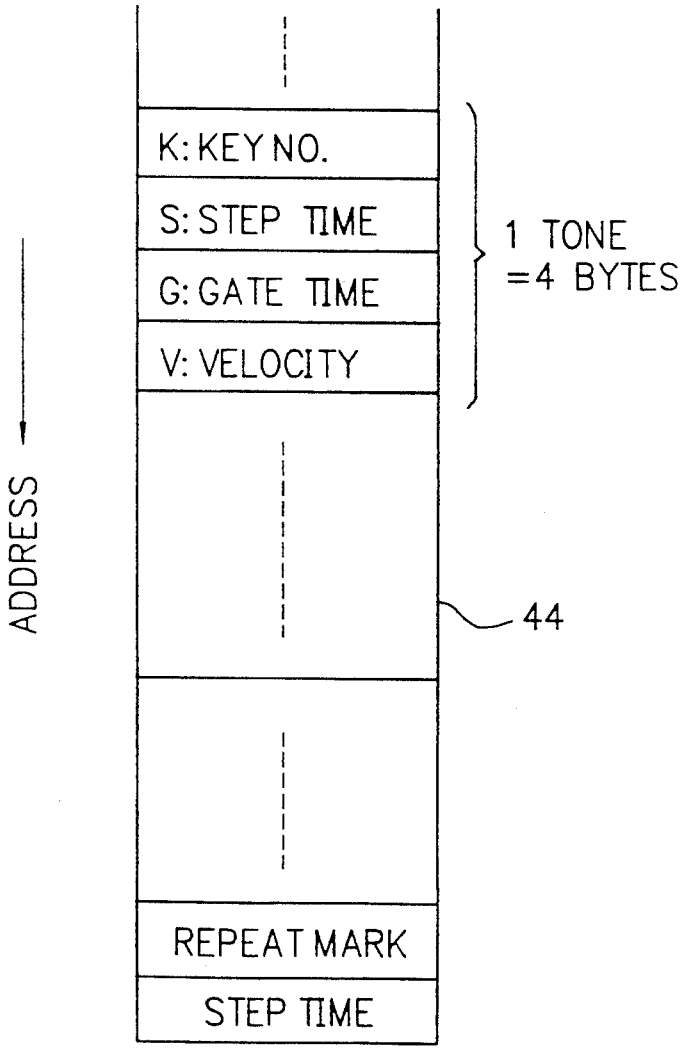
FIG. 6 shows the architecture of note data read out by auto-play pattern data.

FIG. 6 partially shows note data 44 accessed through the intonation pattern data or the phrase data. One tone of the note data includes four bytes, i.e., a key number K, a step time S, a gate time G, and a velocity V. The key number K indicates a scale, the step time S indicates a tone generation timing, the gate time G indicates a tone generation duration, and the velocity V indicates the tone volume (key depression pressure) of a tone. In addition to these data, the note data includes tone color data, a repeat mark of a note pattern, and the like.

Note data are sequentially read out from the auto-play data memory 35 in units of four bytes from an address indicated by the play pattern portion of the intonation pattern data or the phrase data. The tone controller 32 (FIG. 2) performs address control on the basis of the intonation pattern data, modifies the tone volume and key number of the readout tone data with tone volume/instrument designation data of the intonation pattern data or changes the tone color, and supplies the modified data to the tone generator 37.

Figures 7A, 7B, 7C:
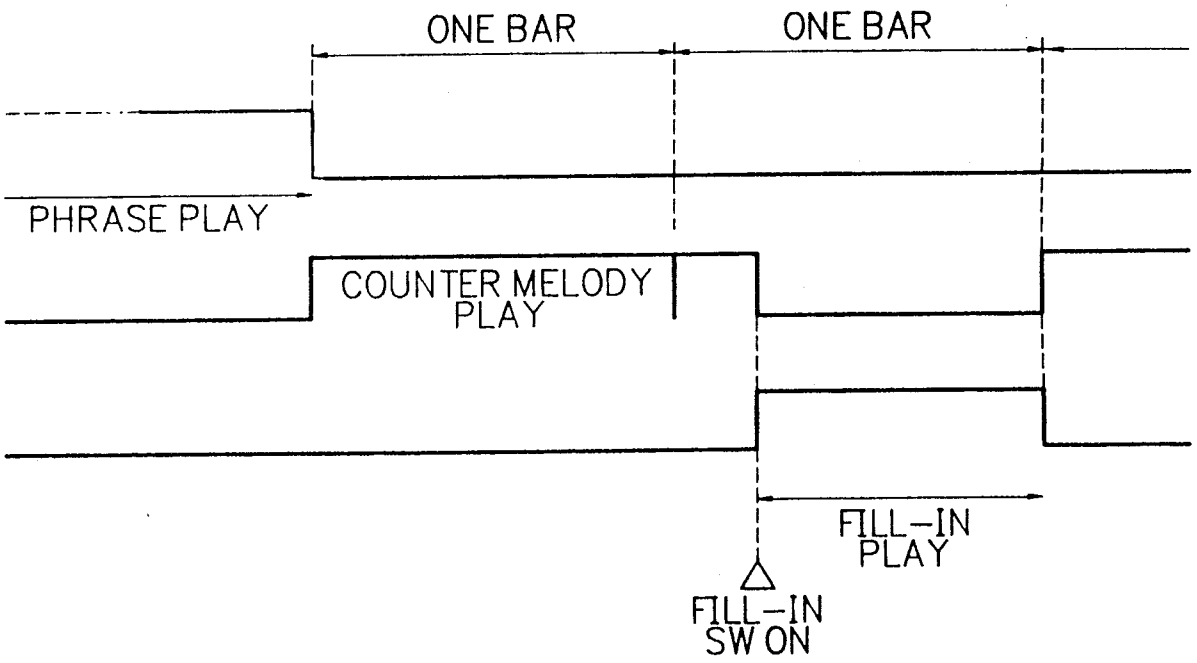
FIGS. 7A to 7C are timing charts of an auto-play operation.

The operation of the auto-play apparatus shown in FIG. 2 will be described below with reference to the timing chart shown in FIGS. 7A to 7C. In the adlib phrase play mode, when one key assigned to a phrase is depressed, the corresponding phrase data is read out from the phrase data memory 33, and note data constituting a 4-beat phase are read out from the auto-play data memory 35 on the basis of the readout phrase data. The readout note data are played back by the tone generator 37 (FIG. 7A). If an intonation value supplied from the intonation operation unit 31 upon operation of the intonation dial 10 is set to be equal to or larger than a given value, when no adlib phrase play key operation is performed, the 17th counter-melody data in the phrase data memory 33 is read out and is repetitively played back in units of bars as a substitution of an adlib play (FIG. 7B). Thus, tracks (tone generation channels) can be prevented from being unused, and the tone-up state of a play when the intonation value is increased is maintained.

When a selection button 12*c* on the panel 12 is depressed so as to insert, e.g., a fill-in phrase as a single phrase in a counter-melody auto-play operation, the designated intonation value is supplied from the single phrase selection unit 38 to the tone controller 32, and for example, a loud fill-in pattern 55 (FIG. 4) is selected. Thereafter, the corresponding fill-in pattern data is read out from the intonation pattern memory 34 (FIG. 2).

The tone controller 32 reads out 4-beat note data per bar corresponding to the fill-in phrase from the auto-play data memory 35 according to the address indicated by the fill-in pattern data, and causes the tone generator 37 to play back fill-in phrase tones from the start timing of a bar (FIG. 7C). Upon completion of the fill-in playback operation for one bar, the counter-melody playback operation is restarted.

Therefore, even when all the tone generation tracks are busy during the counter-melody playback operation so as to obtain the tone-up effect of a play, a fill-in phrase, an ending phrase, and the like can be inserted, thus assuring the degree of freedom of a play.

Note that the tone controller 32 selects one of fill-in patterns 53 to 56 (FIG. 4) with reference to the intonation value set by the intonation operation unit 31.

FIGS. 8 to 19 are flow charts showing auto-play control based on accompaniment pattern data or phrase data. In step 50 in FIG. 8, initialization is performed. In step 51, scan detection processing for operations on the keyboard 11 is performed. If a key ON event is detected, the flow advances from step 52 to step 53 to execute ON event processing; if a key OFF event is detected, the flow advances from step 54 to step 55 to execute OFF event processing. If no key event is detected, operation detection processing of the panel is executed in step 56. Intonation dial processing is then executed in step 57. Furthermore, playback processing of tones is performed in step 58. Thereafter, the flow loops to step 51.

Figure 9:
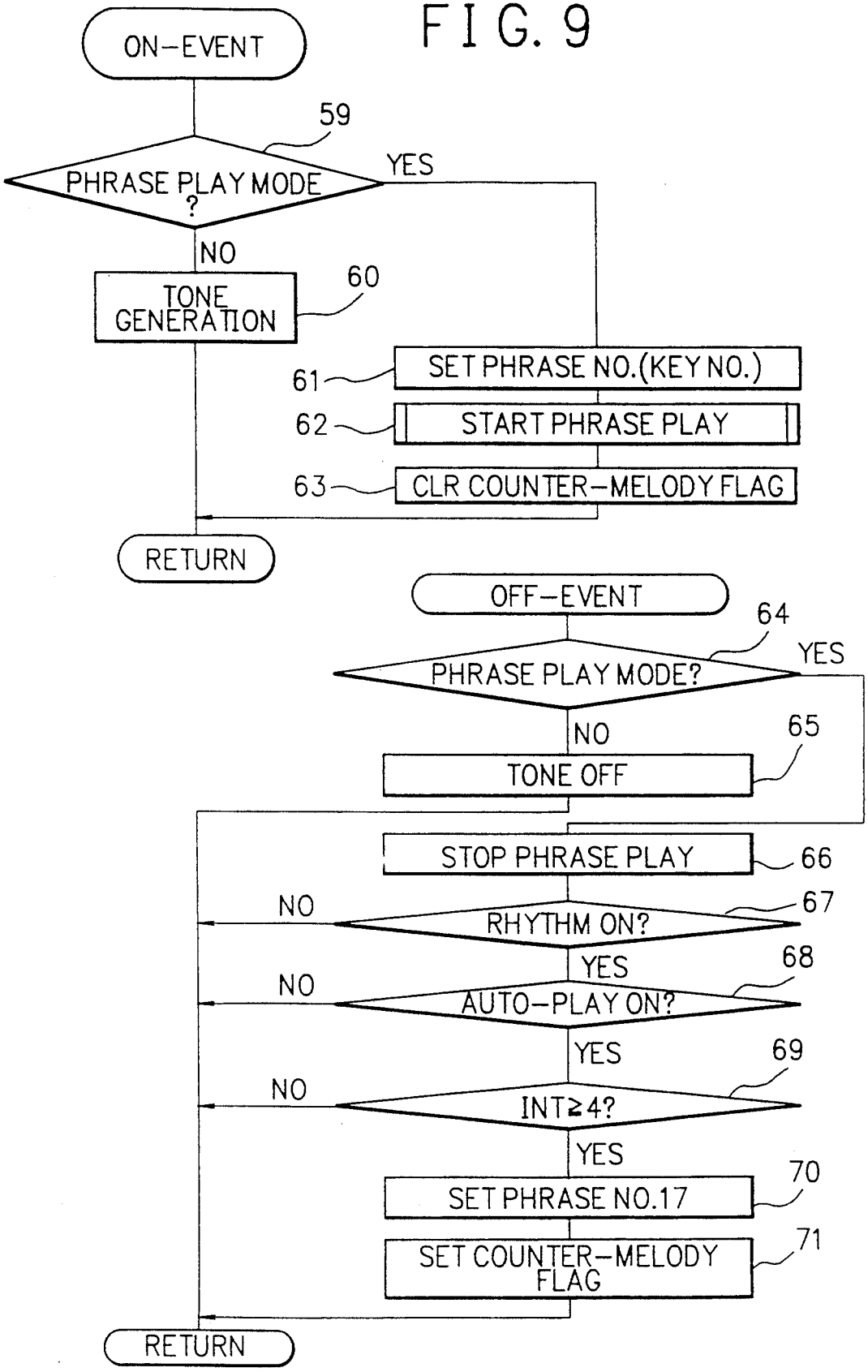

FIG. 9 shows key ON and OFF event processing operations. In the case of an ON event, in step 59, it is checked if a phrase play mode is selected. If NO in step 59, tone generation processing is performed in step 60.

If YES in step 59, a phrase number (key number) is set in step 61. In step 62, phrase play start processing is performed. In step 63, a counter-melody flag is cleared. In the OFF event processing shown in FIG. 9, it is checked in step 64 if the phrase play mode is selected. If NO in step 64, tone OFF processing is performed in step 65. If YES in step 64, the phrase play is stopped in step 66. In steps 67, 68, and 69, it is checked if a rhythm operation and an auto-accompaniment operation are being performed, and the intonation value is 4 or more. If these conditions are satisfied, a phrase number "17" is set in step 70, and the counter-melody flag is set in step 71. More specifically, when adlib phrase play tones are stopped, the auto-play operation of the 17th phrase (counter melody) is started so as not to interrupt the tone-up state of a play halfway. When the intonation value is smaller than 4, since the tone-up level of a play is not so high, the counter-melody play is not performed.

Figure 10:
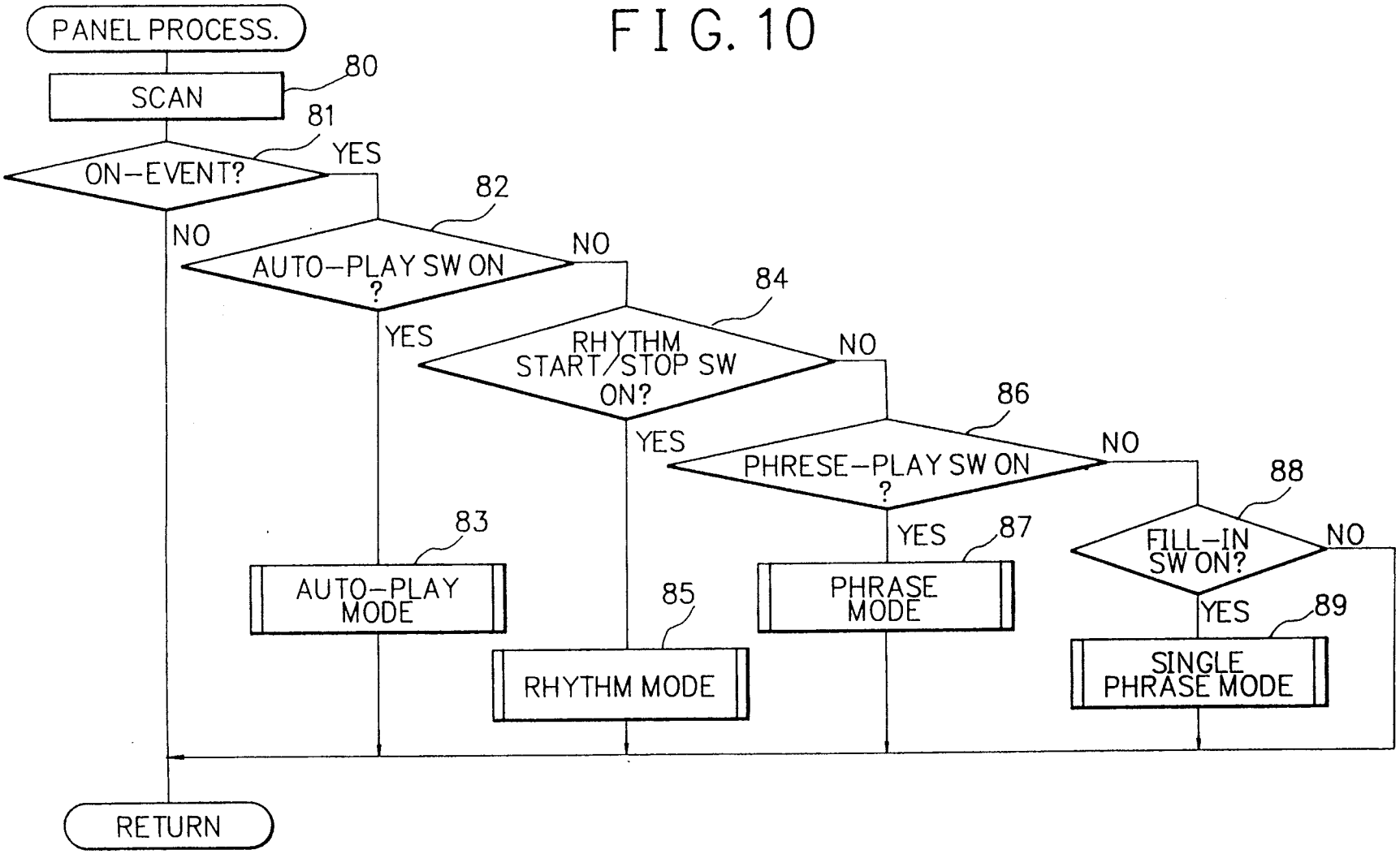

FIG. 10 shows panel processing. In step 80, scan processing is performed. If an ON event is detected, the flow advances from step 81 to steps 82, 84, 86, and 88 (switch detection processing). When an auto-play switch of the selection switches 12*a* of the operation panel 12 is turned on, auto-play mode processing in step 83 is executed. When a rhythm start/stop switch is turned on, rhythm mode processing in step 85 is executed. When a phrase play switch is turned on, phrase mode processing in step 87 is executed. When a selection button 12*c* of, e.g., a fill-in phrase on the operation panel 12 is turned on, single phrase mode processing in step 89 is executed.

Figure 11:
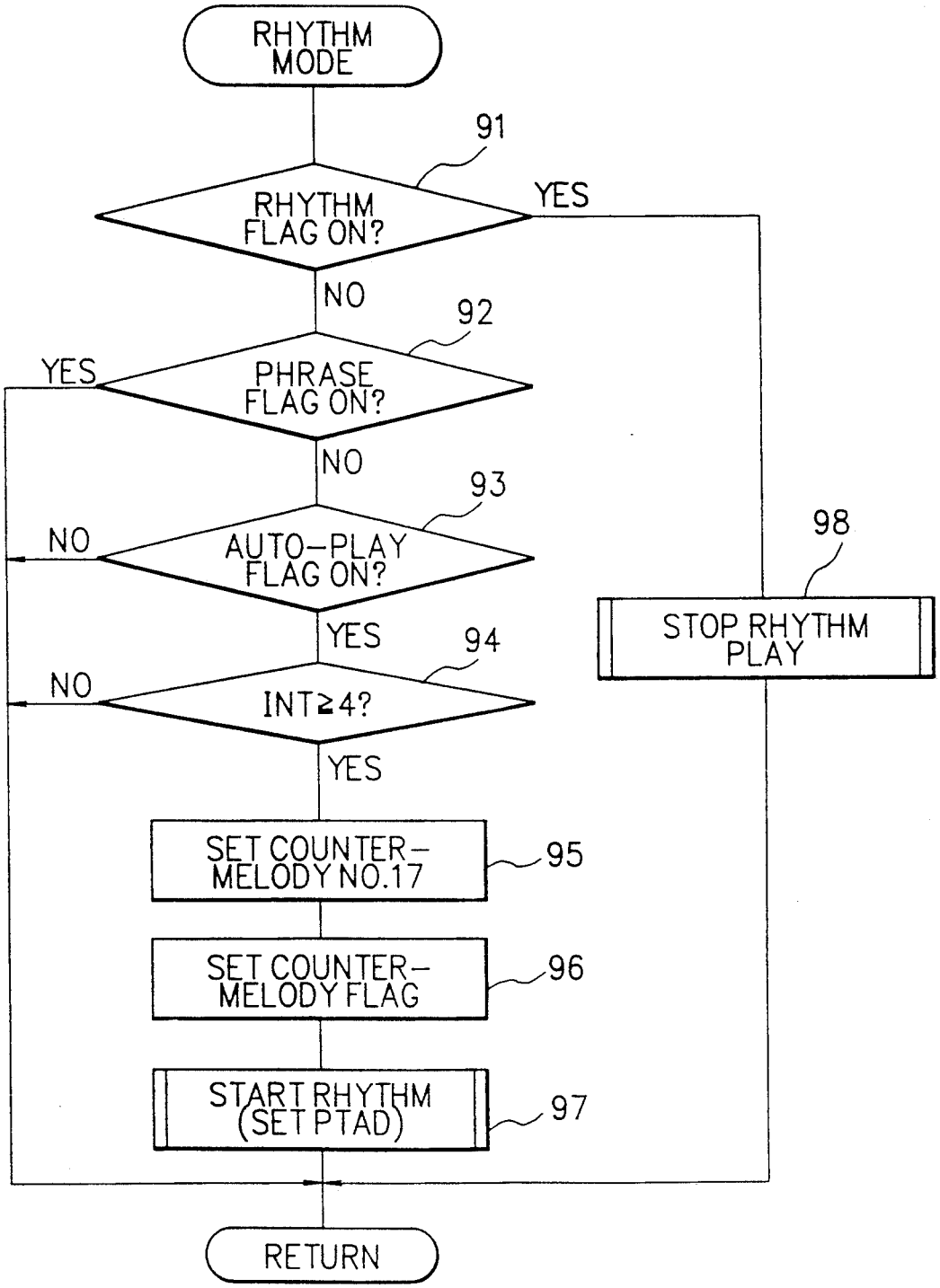

FIG. 11 shows the rhythm mode processing in step 85. In this mode processing, it is checked in step 91 if a rhythm flag is ON. If NO in step 91, rhythm start processing is performed in step 97 via steps 92 to 96. In steps 92 to 96, processing for, when predetermined conditions are satisfied, setting the counter-melody flag is performed. When a phrase play flag is OFF, if an auto (auto-accompaniment) flag is ON and the intonation value is 4 or more, the phrase number "17" of a counter melody is set, and the counter-melody flag is set. If it is determined in step 91 that the rhythm flag is ON, rhythm stop processing is performed in step 98.

Figure 12:
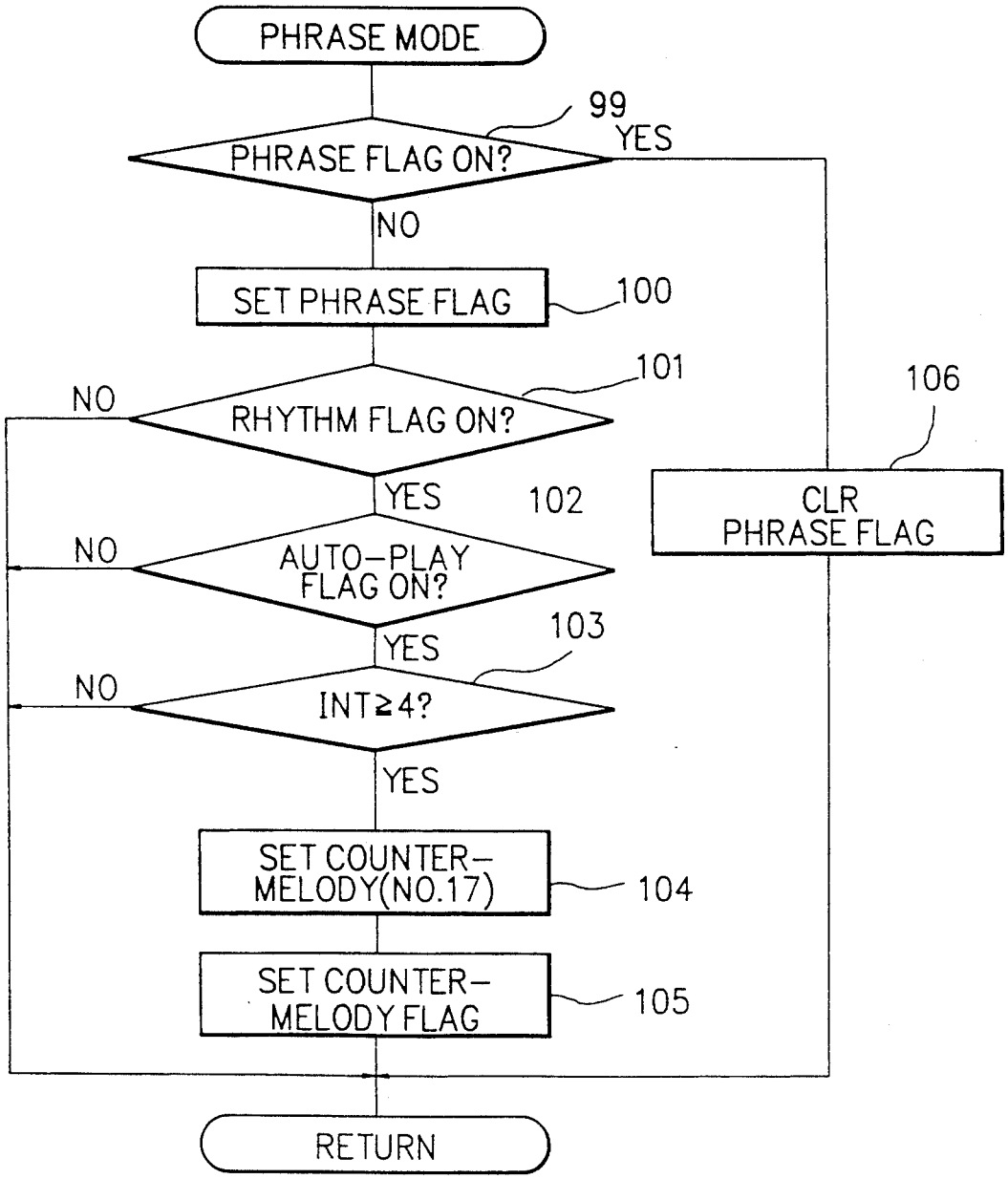

FIG. 12 shows the phrase mode processing. In this mode processing, it is checked in step 99 if a phrase flag is ON. If NO in step 99, the phrase flag is set in step 100, and the counter-melody flag is set when the predetermined conditions are satisfied in steps 101 to 105. More specifically, when the rhythm flag is ON, the auto (auto-accompaniment) flag is ON, and the intonation value is 4 or more, the phrase number "17" of a counter melody is set, and the counter-melody flag is set. If it is determined in step 99 that the phrase flag is ON, phrase flag clear processing is performed in step 106.

Figure 13:
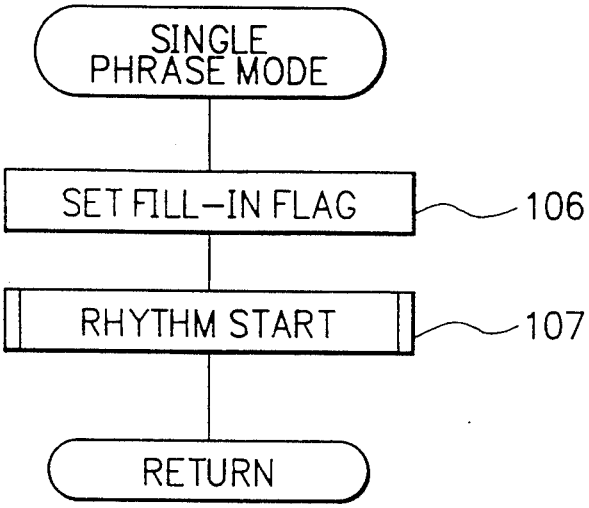

FIG. 13 shows the single phrase mode processing show in FIG. 10. For example, when the fill-in selection button 12*c* is depressed, a fill-in flag is set in step 106, and rhythm start processing is performed in step 107.

Figure 8:
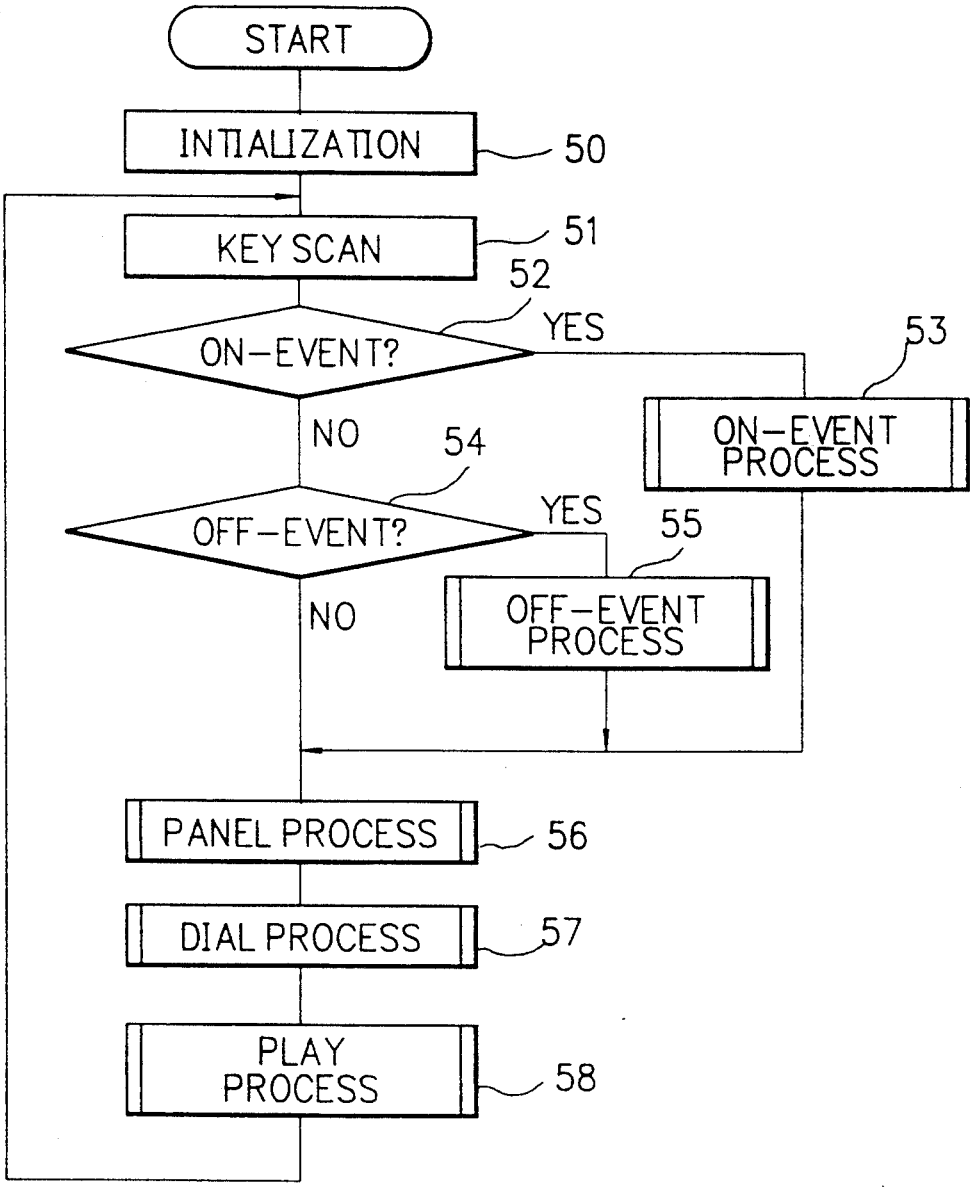
FIGS. 8 to 19 are flow charts showing auto-play control.
Figure 14:
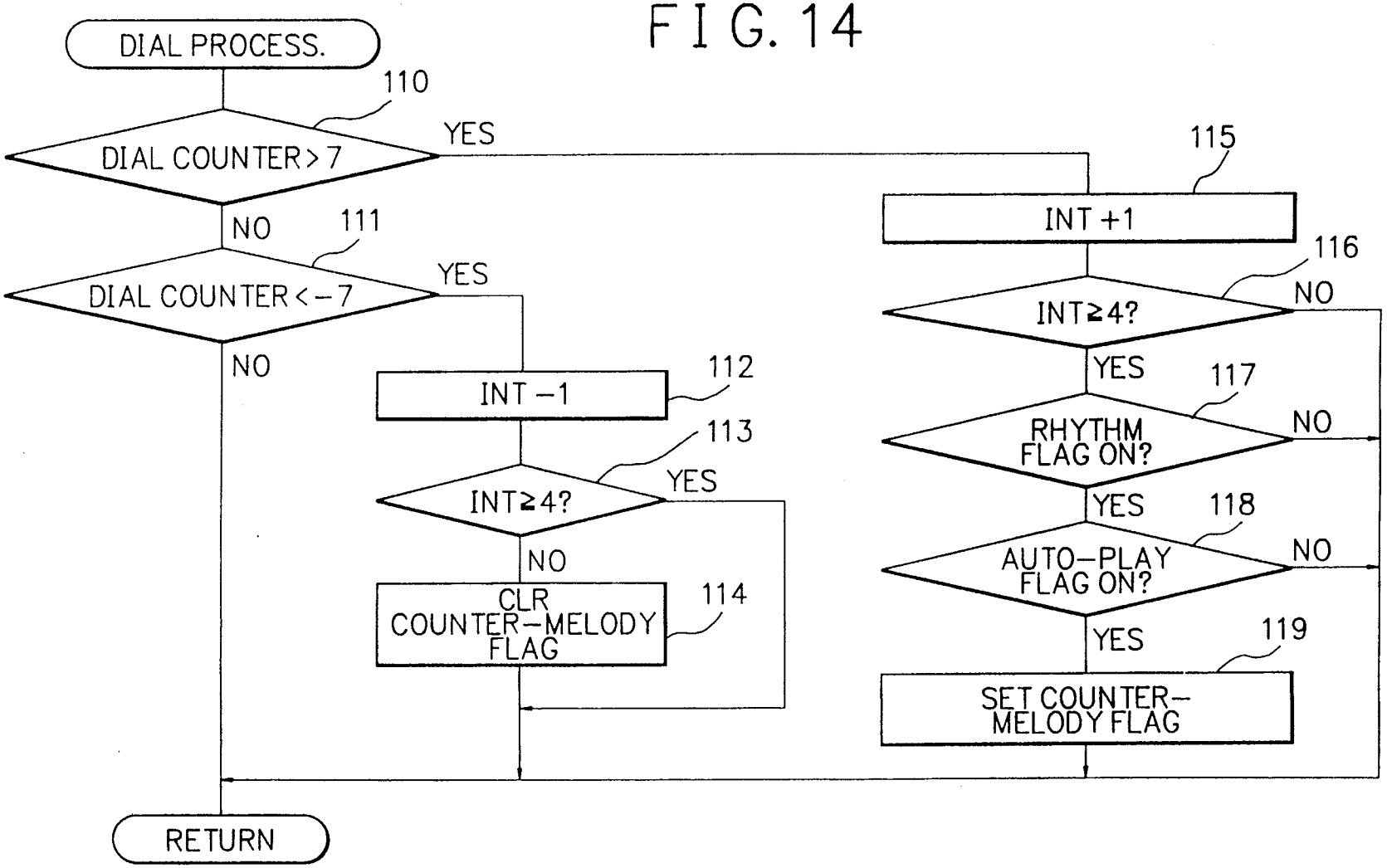

FIG. 14 shows dial count processing in step 57 in the main routine shown in FIG. 8. In this processing, the intonation value is changed in response to the operation of the dial 10. In steps 110 and 111, it is checked if the count value of the output pulses from the pulse generator 14 is larger than 7 or smaller than −7. If the count value is larger than 7, the intonation value is incremented by "+1"; if the count value is smaller than −7, the intonation value is decremented by "−1" (steps 115 and 112). Note that about ⅓ revolution of the dial 10 corresponds to the count value "7". When the dial 10 is rotated clockwise, the count value is increased; when it is rotated counterclockwise, the count value is decreased. When the intonation value is incremented by "+1", the counter-melody flag is set if the predetermined conditions are satisfied in steps 116 to 118. More specifically, when the rhythm flag is ON, the auto (auto-accompaniment) flag is ON, and the intonation value is 4 or more, the phrase number "17" of a counter melody is set, and the counter-melody flag is set. When the intonation value is decremented by "−1", it is checked in step 113 if the intonation value is 4 or more. If NO in step 113, the counter-melody flag is cleared in step 114.

Figure 15:
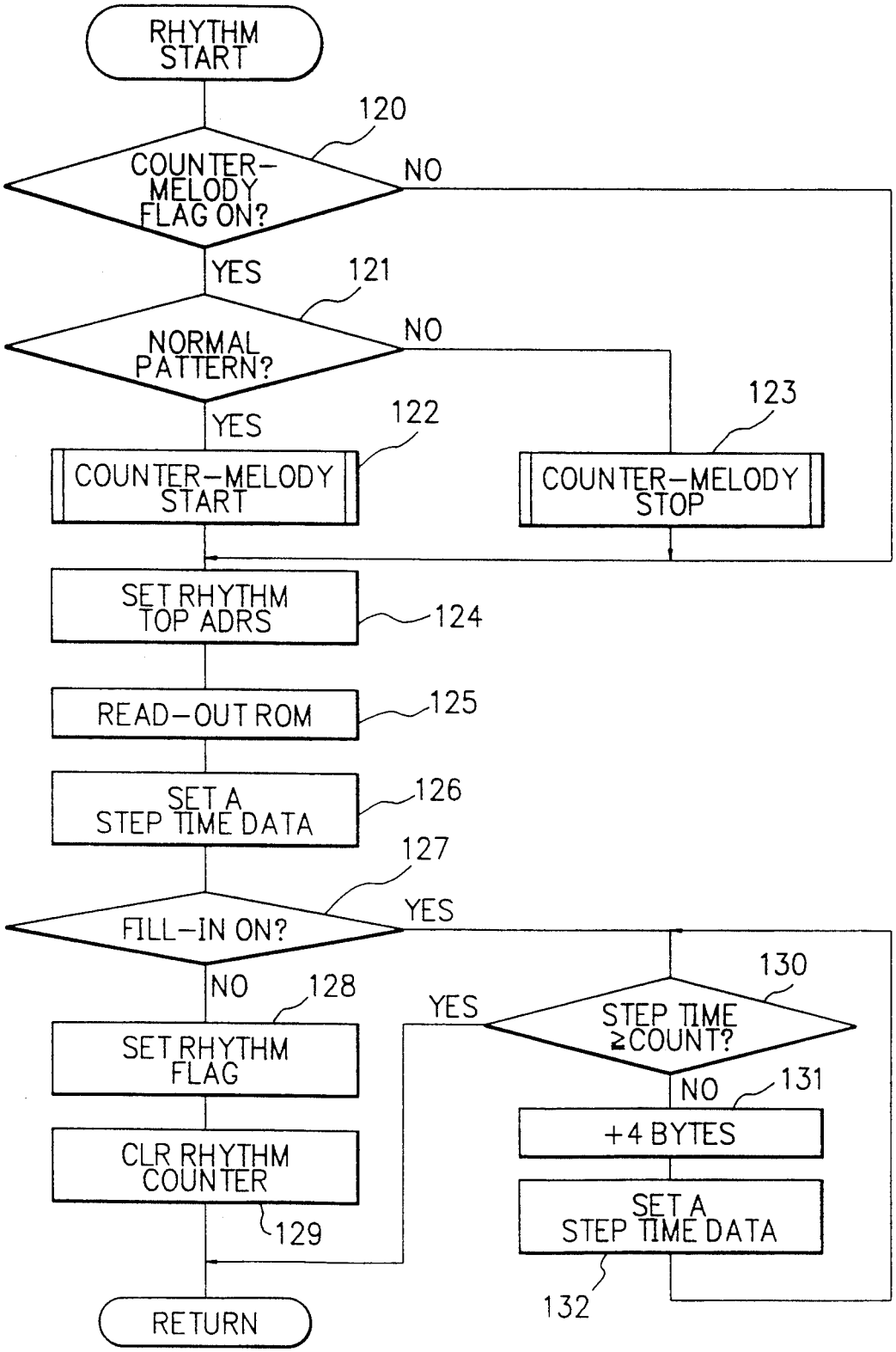

FIG. 15 shows a rhythm start routine in step 97 in FIG. 11 or in step 107 in FIG. 13. In step 120, it is checked if the counter-melody flag is ON. If YES in step 120, it is checked in step 121 if the rhythm pattern is normal. If a normal rhythm pattern other than an introduction pattern, a fill-in pattern, and the like is selected, a counter melody is started in step 122. If a phrase pattern such as an introduction pattern, a fill-in pattern, and the like is selected, counter-melody stop processing is performed in step 123. If it is determined in step 120 that the counter-melody flag is OFF, and when the processing in step 122 or 123 is ended, the top address of intonation pattern data corresponding to a rhythm number is set in step 124, and note data corresponding to the address are read out from the auto-play data memory 35 in step 125.

In step 126, step time data in the note data is set in a register. It is then checked in step 127 if the fill-in flag is ON. If NO in step 127, a rhythm ON flag is set in step 128, and a rhythm time-base counter is cleared in step 129. If it is determined in step 127 that the fill-in flag is ON, it is checked in step 130 if the set step time data is equal to or larger than the current count value of a rhythm counter. If NO in step 130, the read address of the ROM is advanced by 4 bytes in step 131. In step 132, step time data of the next note data is set in the register, and the flow returns to step 130 to repeat the above-mentioned processing. If it is determined in step 130 that the step time data exceeds the count value, the flow returns to the main flow and the playback operation of a fill-in phrase is performed. Therefore, a fill-in phrase is played back from its intermediate timing corresponding to the count value of the rhythm counter so as not to disturb the bar period currently played, as shown in FIG. 7C.

Figure 16:
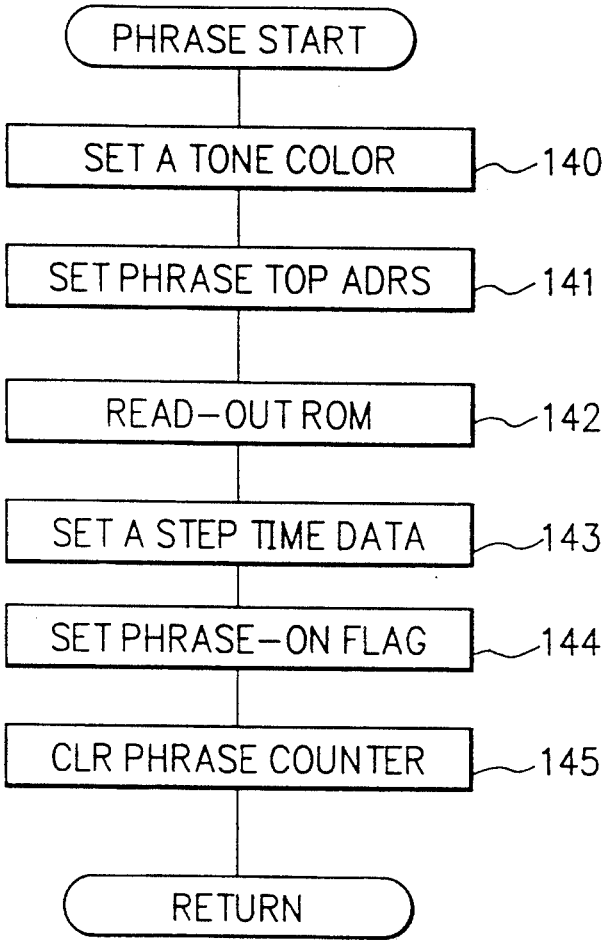

FIG. 16 shows processing when an adlib phrase play or a counter-melody play is started. In step 140, a tone color is set. In step 141, the top address of phrase data is set. Thereafter, in step 142, ROM data is read out. In step 143, the first step time data is set. In step 144, the counter-melody (phrase play) flag is set, and in step 145, a time-base counter for a counter melody (phrase play) is cleared.

Figure 17:
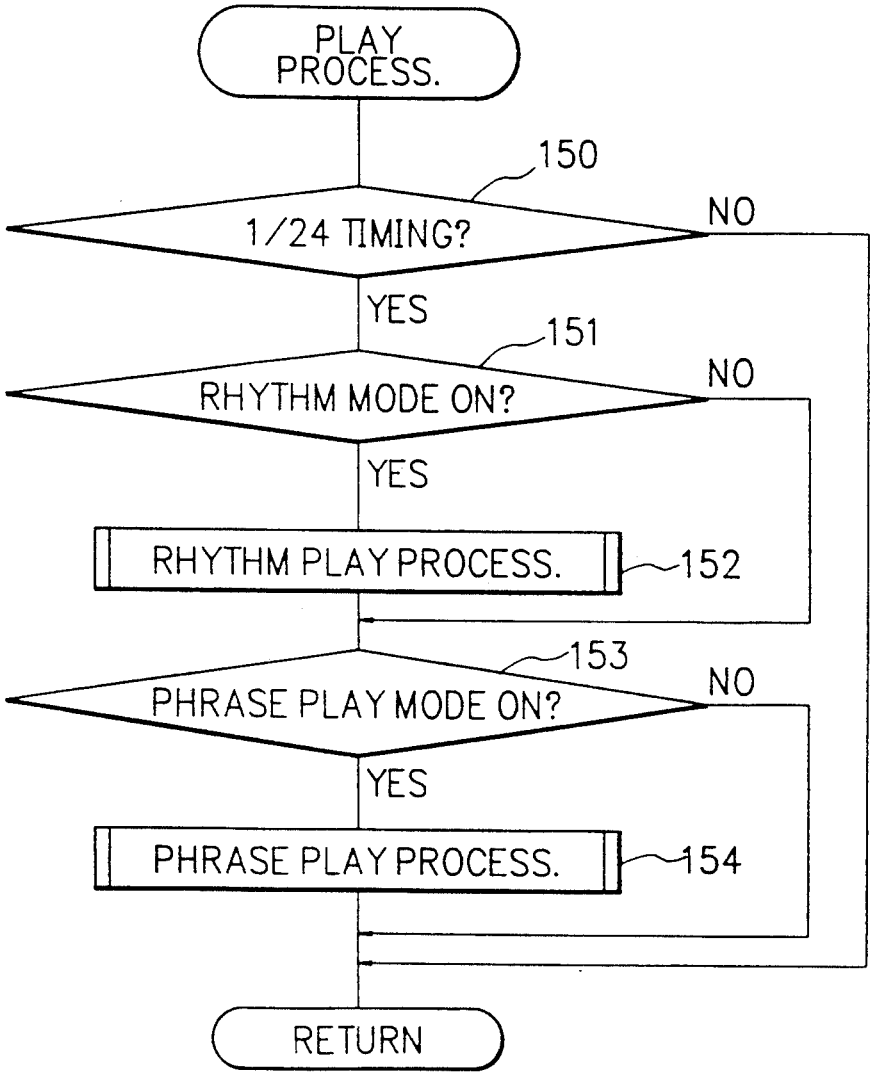

FIG. 17 shows an auto-accompaniment note playback processing routine corresponding to step 58 in FIG. 8. In this routine, it is checked in step 150 if a timing 1/24 one note is reached. If YES in step 150, a rhythm play mode flag is checked in step 151. If the flag is ON, rhythm playback processing is performed in step 152. Furthermore, a phrase play mode flag is checked in step 153. If the flag is ON, phrase playback processing is performed in step 154.

Figure 18:
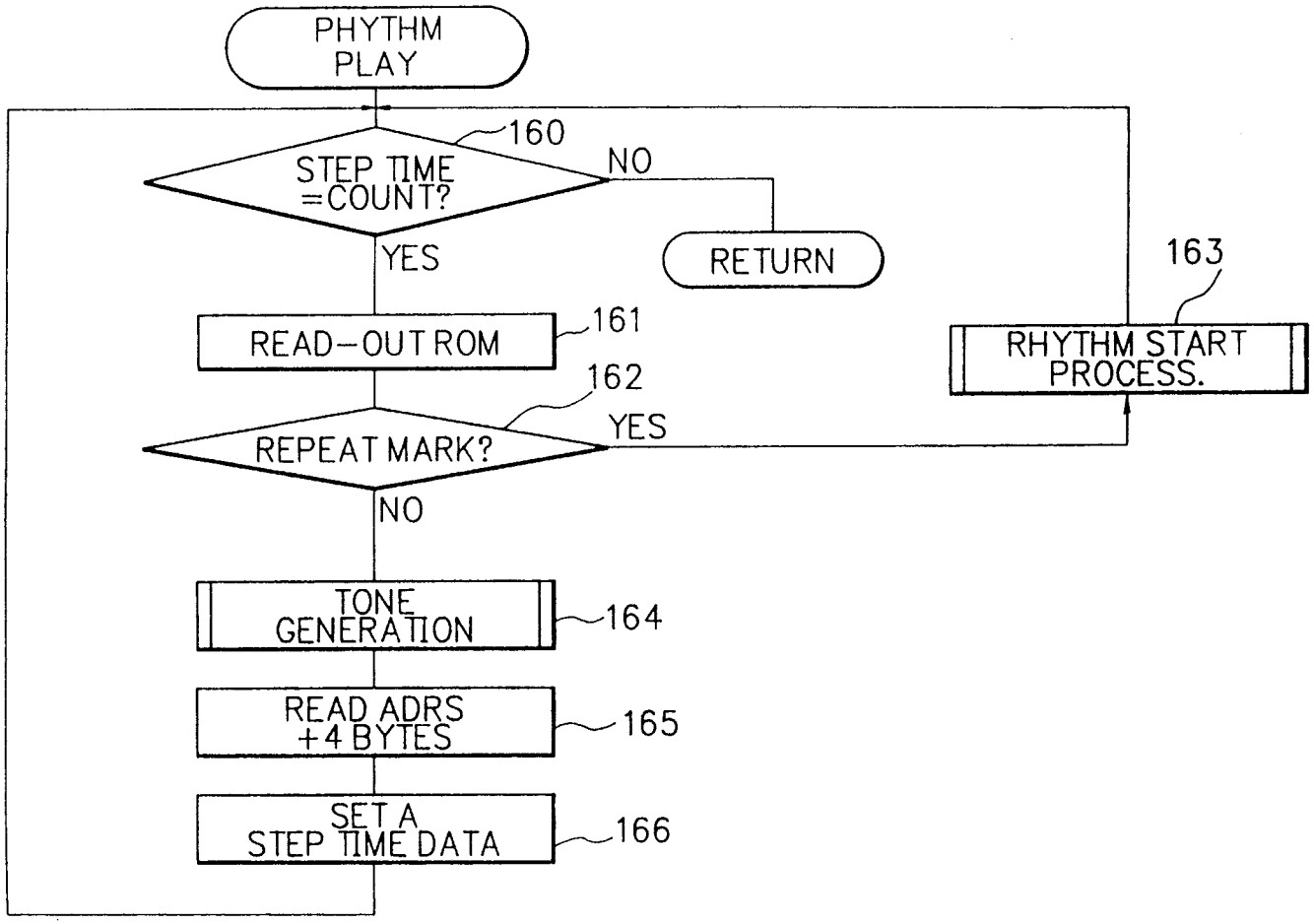

FIG. 18 shows the rhythm playback processing in step 152. It is checked in step 160 if the count value of the rhythm counter has reached step time data set in the rhythm start routine (FIG. 15). If YES in step 160, tone generation data for one note is read out from the ROM in step 161, and it is checked in step 162 if the readout data is a repeat mark. If NO in step 162, tone generation processing is performed in step 164. In step 165, the read address is advanced by four bytes. In step 166, the next step time data is set. The flow then returns to step 160 to repeat the above-mentioned processing. If a repeat mark is detected in step 162, rhythm start processing is performed in step 163, and the flow returns to step 160 to repeat the processing.

Figure 19:
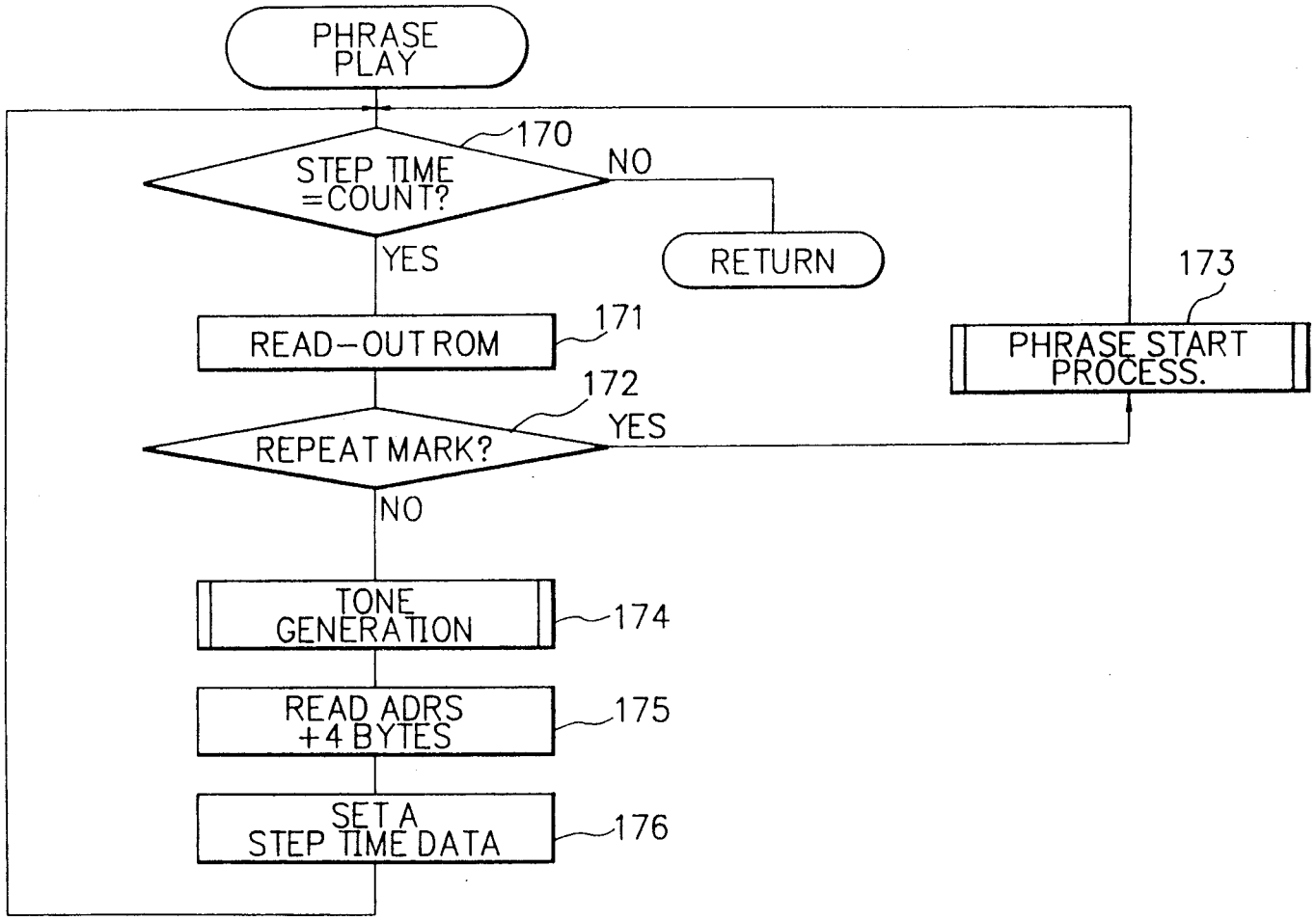

FIG. 19 shows the phrase playback processing in step 154 (FIG. 17). It is checked in step 170 if the count value of the phrase counter has reached step time data set in the phrase start routine (FIG. 16). If YES in step 170, tone generation data for one tone is read out from the ROM in step 171, and it is checked in step 172 if the readout data is a repeat mark. If NO in step 172, tone generation processing is performed in step 174. In step 175, the read address is advanced by four bytes. In step 176, the next step time data is set. The flow then returns to step 170 to repeat the above-mentioned processing. If it is determined in step 172 that a repeat mark is detected, phrase start processing is performed in step 173, and the flow returns to step 170 to repeat the processing.

In the auto-play apparatus of the present invention, a note data string corresponding to one of different phrases assigned to a plurality of keys is selected according to a key operation, and is supplied to the tone generation means. When the key operation is interrupted while a phrase assigned to a key corresponding to the key operation is being played, the note data string corresponding to a specific phrase is repetitively selected, and is supplied to the tone generation means. In addition, when a selection operation member is operated while the specific phrase is being played, one phrase corresponding to the selection operation member is played in place of the play operation of the specific phrase, and upon completion of the play, the repetitive play operation of the specific phrase is restarted.

Therefore, when an adlib play of phrases is performed in correspondence with key operations, the intervals between adjacent key operations can be filled with an auto-play operation of a specific phrase, and the tone-up state of a play can be maintained. Since no special-purpose tracks for this auto-play operation are necessary, high-grade functions can be obtained without increasing cost.

Even when all tracks are busy due to the auto-play operation of the specific phrase, a phrase such as a fill-in phrase, an ending phrase, and the like can be desirably inserted, and the high tone-up state can be further emphasized by varying the play pattern.

What is claimed is:

1. An auto-play apparatus comprising:

note data storage means for storing note data strings of auto-play tones containing accompaniment tones and melodious phrases;

tone generation means for generating tones based on the note data strings read out from said note data storage means;

means for selecting a note data string corresponding to one of different phrases assigned to a plurality of keys according to a key operation, and supplying the selected note data string to said tone generation means;

means for selecting a note data string corresponding to a phrase assigned to at least one selection button, and supplying the selected note data string to said tone generation means;

means for, when the key operation is interrupted while a phrase play for generating phrase tones in response to key operations is being performed, repetitively selecting the note data string corresponding to one specific phrase, and supplying the selected note data string to said tone generation means; and interrupt means for, when said selection button is operated while the specific phrase is being played, playing one phrase corresponding to said selection button in place of a play operation of the specific phrase, and restarting a repetitive play operation of the specific phrase upon completion of the play operation of one phrase corresponding to said selection button.

2. The apparatus of claim 1, further comprising phrase play pattern storage means for storing, as play patterns, read control data for reading out the note string data constituting the phrase from said note data storage means, and wherein said phrase play pattern storage means stores the read control data of the phrases assigned to the keys, and the specific phrases.

3. The apparatus of claim 1, further comprising intonation value varying means for increasing/decreasing an intonation value in correspondence with a tone-up level of a play, and wherein said means for supplying the specific phrase to said tone generation means selects the specific phrase when the intonation value exceeds a predetermined value, and no key operation is performed.

4. The apparatus of claim 1, further comprising:

intonation pattern storage means for storing intonation patterns of a plurality of levels corresponding to tone-up levels of a play; and tone control means for reading out the note data string of accompaniment tones from said note data storage means on the basis of the intonation pattern data corresponding to the intonation value, correcting the tone-up level of the note data, and supplying the corrected note data to said tone generation means, and wherein the intonation pattern data of the different levels include at least one of designation information for designating different read positions of said note data storage means, pieces of different tone volume information for correcting the tone-up level of the readout note data, pieces of different tone color information, and pieces of different instrument information, and the phrase corresponding to said selection button is stored as an intonation pattern of a specific level.

5. The apparatus of claim 1, wherein play patterns of the different phrases assigned to the plurality of keys and play patterns which are not assigned to keys are stored in units of types of rhythms.

6. The apparatus of claim 3, wherein said intonation value varying means has a dial shape.

7. The apparatus of claim 1, wherein the note data of the accompaniment tones constitute chord, bass, and drum parts having a specific rhythm pattern.

8. The apparatus of claim 1, wherein the phrases assigned to the keys include 16 phrases assigned to keys across two octaves.

9. The apparatus of claim 1, wherein the phrase assigned to said selection button is one of the fixed phrases including an introduction phrase, a fill-in phrase, an ending phrase, which are required according to a flow of a play.

* * * * *